United States Patent [19]

Davey

[11] 4,028,457

[45] June 7, 1977

[54] CONSOLIDATION OF DRY FORMED WEBS

[75] Inventor: Roger George Davey, Hudson Heights, Canada

[73] Assignee: Domtar Limited, Montreal, Canada

[22] Filed: June 20, 1975

[21] Appl. No.: 588,881

Related U.S. Application Data

[63] Continuation-in-part of Ser. No. 458,798, April 8, 1974, abandoned.

[30] Foreign Application Priority Data

Apr. 16, 1973 Canada ..... 168790

[52] U.S. Cl. ..... 264/120

[51] Int. Cl.[2] ..... D04H 1/64

[58] Field of Search ..... 264/120, 128, 115

[56] References Cited

UNITED STATES PATENTS

| | | | |
|---|---|---|---|
| 2,872,337 | 2/1959 | Heritage et al. | 264/128 |
| 2,983,627 | 5/1961 | Williams | 264/128 |
| 3,230,287 | 1/1966 | Caron et al. | 264/120 |
| 3,773,587 | 11/1973 | Flewwelling | 264/119 |

*Primary Examiner*—Robert F. White
*Assistant Examiner*—James R. Hall
*Attorney, Agent, or Firm*—C. A. Rowley

[57] ABSTRACT

A method of forming a paper-like sheet from a dry formed web by pre-bonding the web thereby strengthening it sufficiently that it may traverse a conventional size press but without unduly inhibiting the ability of the web to be penetrated by a binder in a liquid carrier, applying said binder to the pre-bonded web, distributing said binder in said web in a size press at a pressure of 20–150 lbs/linear inch, a temperature of 15° – 80° C and a web speed of at least 50 ft/minute and drying the web to provide a bonded sheet.

7 Claims, 3 Drawing Figures

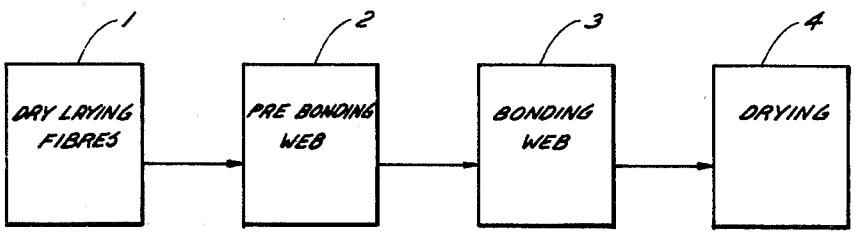
FIG. 1
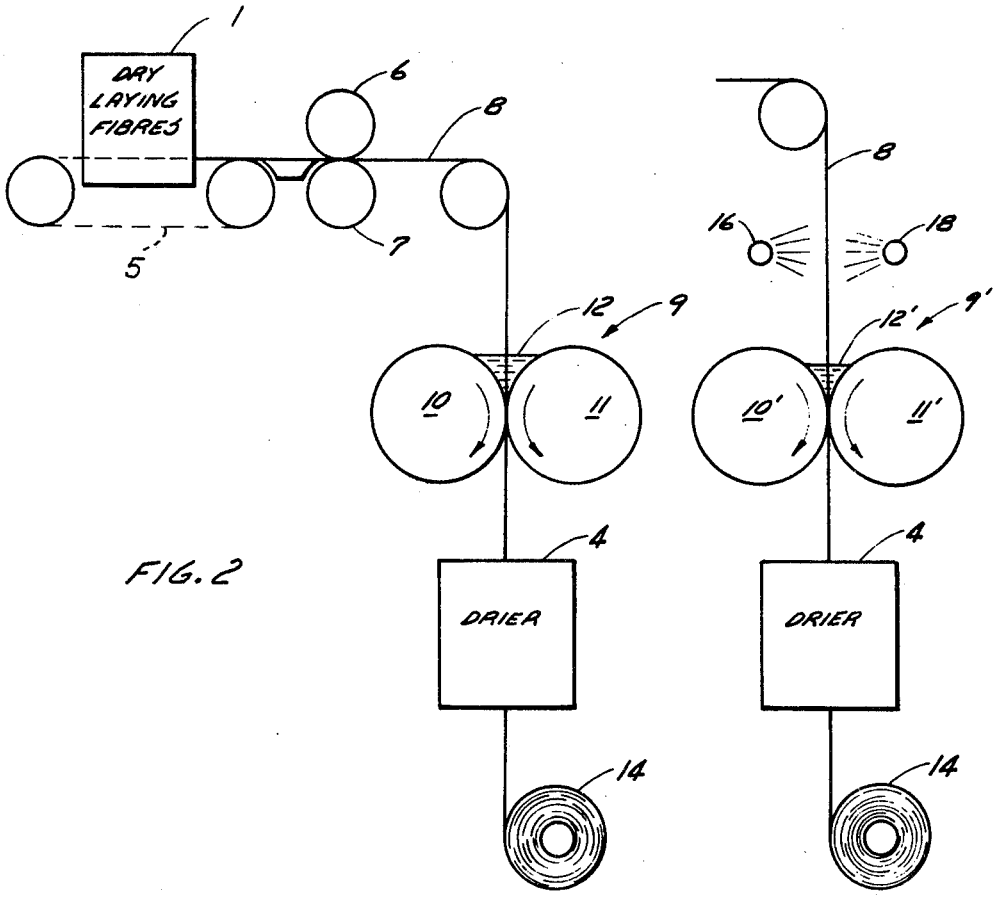
FIG. 2
FIG. 3

CONSOLIDATION OF DRY FORMED WEBS

This application is a continuation in part of application No. 458,798 filed Apr. 8, 1974 and now abandoned.

FIELD OF THE INVENTION

The present invention relates to consolidation of dry formed fibrous webs, more particularly, the present invention relates to bonding a web of discrete fibres to form paper or a paper-like product.

DESCRIPTION OF THE PRIOR ART

Attempts have been made to produce paper-like products by bonding of dry formed webs. The techniques used are difficult to apply and generally require complex equipment. Examples of such techniques include applying a binder by dipping a dry formed web into a bath of binder, adding the binder in dry powder form as the web is formed, or spraying a binder to a web.

Equipment for dipping a dry formed web into a bath of binder requires some means of holding the web to prevent it from disintegrating as it enters and traverses the bath. Normally, the web is held between a pair of wires as it passes through the bath, but these wires may impart an embossed pattern to the web resulting in a web of limited utility. Furthermore the dipping of the dry formed web into the bath of binder saturates the web with an excess liquid that has to be removed by pressing which further embosses the web and by drying thereby further increasing the costs of production.

As above indicated, attempts have been made to apply binders to the dry formed web as it is being produced, i.e. by mixing binder with the fibres in the laying head. When this technique is used, difficulty is encountered in obtaining uniform binder distribution. Furthermore, this technique limits the types of binders that may be used.

The technique of spraying a formed web is not generally satisfactory as proper binder saturation of the web is not generally obtained. If the binder is applied before pressing, an excess of carrier liquid is required and in many cases retaining screens will be necessary to prevent the web from being disrupted by the sprays.

It has also been proposed to produce a paper-like web simply by pressing it under conditions of high pressure and temperature. Generally, these methods require that specific moisture content be maintained in the web and that the web be pressed at an elevated temperature generally above 110° C. The bond produced by this technique is not entirely satisfactory.

The bonding problem is further complicated where short fibres such as wood pulp fibres are to be used in forming the paper-like product. Canadian Patent No. 558,783 clearly indicates one of these problems by stating that, to handle dry formed webs having over 80% short fibre (wood pulp fibre), the amount of long fibre is unsufficient to permit continuing a process through steps when liquid or dry binder is added to the web. Even with spray application, the problems in handling a dry formed web of wood pulp fibres and spraying on a binder after formation are well recognized in the art.

SUMMARY OF THE INVENTION

It is an object of the present invention to provide a method of bonding a dry formed web that will permit continuous binder application using relatively simple equipment.

It is a further object of the present invention to provide a system which permits the use of a size press saturating technique for applying binder to a dry form web.

Broadly, the present invention comprises dry forming a web from discrete fibres, prebonding the web sufficiently that the web will not disintegrate in a subsequent pressing step but without unduly modifying the web in a manner which would significantly impair the penetratability of the web by a binder in a liquid carrier, applying said binder passing, said web and binder through a size press at a nip pressure of 20 – 150 lbs/linear inch, a binder liquid temperature of 15 to 18° C and a speed of at least 50 ft/minute thereby to distribute said binder uniformly through said web and drying the web to form a bonded consolidated web.

BRIEF DESCRIPTION OF THE DRAWINGS

Further features, objects and advantages will be evident from the following detailed description of a preferred embodiment of the present invention taken in conjunction with the accompanying drawings in which:

FIG. 1 is a schematic diagram illustrating the concept of the present invention;

FIG. 2 is a schematic illustration of the preferred form of the present invention; and FIG. 3 is a schematic view of a section of FIG. 2 showing a modification.

DESCRIPTION OF THE PREFERRED EMBODIMENTS

Referring to FIG. 1, the dry fibres for example wood pulp fibres, are dry laid using conventional techniques to form a web of the desired basis weight as indicated by numeral 1. The so-formed web is then treated in a pre-bonding station indicated at 2 wherein the web is lightly pre-bonded to impart sufficient strength to permit the web to be carried through the subsequent bonding step designated at 3. After the binder is applied at 3 the web is dried at 4 to complete the bonding (assuming an adhesive in a liquid carrier is used in 3).

Care must be taken that the pre-bonding at 2 be carried out under cnditions that are compatible with bonding step 3. As indicated it is very important that the pre-bonded web have sufficient strength to withstand the treatment applied at step 3, but it also is very important that the web be in an open condition to easily receive the treatment to be applied at station 3, i.e. the web must be easily penetrated by the adhesive applied at 3. Also care must be taken to ensure that when the web is wetted at station 3, it does not release the bond applied in station 2 to the point where the process becomes inoperable.

In the preferred arrangement, as illustrated in FIG. 2, the web is laid with conventional equipment in the forming station 1 and is carried from the forming station 1 on the forming screen 5 onto a prepress station formed by a pair of press rolls 6 and 7.

It has been found that applying pressure between a pair of press rolls 6 and 7, webs of a wide variety of basis weights from above about 25 grams per square meter may be bonded to the required extent to permit subsequent treatment in a size press. Generally the conditions prevailing in the prepress defined by the rolls 6 and 7 will vary depending on various factors including basis weight of the web being treated, the fibre length, type of fibres being treated, the moisture content of the web and the conditions in the size press (i.e. the viscosity, etc., of the solution being applied at the size press). Generally, it has been found that a pressure within about 500 to 3000 lbs. per linear inch for a pair of 6 inch diameter rolls is satisfactory for a wide range of combinations of factors with the specific pressure being set for each web processed. If the pressure is too low, there will be insufficient bonding of the fibres to permit the web to traverse the size press, but if the pressure is too high penetration by the binder at the size press may be inhibited. Thus, generally the prepress will be operated under conditions to achieve sufficient bonding without increasing the density of decreasing the porosity to a point where the size press will not function effectively.

As above indicated, the moisture content of the web has a direct bearing on the pressure required in the prepress formed by rolls 6 and 7, particularly when cellulose fibres are being processed. It has been found that with cellulosic fibres the moisture content should be in the range of 4 to 25% based on the weight of the cellulose fibre. Generally, the higher the moisture content of the web the lower the pressure necessary. However, the moisture content should not be so high as to require supporting the web mechanically as it traverses the prepress.

It is preferable to operate the prepress at room temperature (about 15° C). Operation at elevated temperatures over about 100° C requires extra care to ensure that penetration of the binder at the size press is not inhibited. It has been found that depending on the characteristics of the fibres being processed, i.e. the composition, fibre length, moisture content, etc., operating at elevated temperature results in densifying at least the surface of the web which inhibits the penetration at the size press and prevents implementation of the present invention. Room temperature operation avoids these difficulties yet permits adequate pre-bonding of the web.

As above indicated, the web 8 leaving the pressing rolls 6 and 7 in the prepress station has sufficient strength to traverse the size press generally designated at 9 while retaining its ability to be penetrated by the solution applied in the press 9.

Size press 9 is composed of a pair of opposed press rolls 10 and 11 at least one of which has a rubber coating with a P and G hardness in the range of about 15 to 50. The rubber covering may be slightly harder, (e.g. a P and G of 5 to 15) if a proper technique for producing such a covering with a uniform hardness were available.

The pressure in the nip should be in the range of 20 to 150 lbs. per linear inch and the temperature of the binder in the liquid carrier should be between 15° C to 80° C. Generally the roll diameters will be in the range of about 6 to 30 inches and the speed through the nip will be 50 to 2500 ft. per minute resulting in a maximum residence time of the material in the nip of about 0.05 seconds.

In all cases the nip will be flooded, i.e. a puddle 12 will be provided at the inlet side of the rolls 10 and 11 on opposite sides of the web 8, i.e., both sides of the web 8 will be wetted by the puddle 12 on the incoming side of the size press.

After saturation in the press 9 the web 8 is carried through a drier schematically illustrated at 4, and is eventually wound on a reel generally designated at 14. If desired, the web after drying may be subsequently processed or treated as conventional paper formed by the wet forming route.

In the preferred embodiment of the present invention, the first bonding or prebonding is obtained by a separate and distinct mechanism from the second bonding or final bonding formed by adhesive applied in the size press.

Generally, any suitable adhesive that may be applied in the size press may be used to permanently bond the fibres together into a paper or paper-like sheet, however, it is preferred for economic reasons to use relatively inexpensive adhesives such as animal glue, starches or carboxymethyl cellulose. Usually the adhesives will be present in the amount of between 2 and 20% adhesive based on the dry weight of the fibres depending on the characteristics desired and the type of adhesives used.

Referring to FIG. 3 as shown, instead of applying the binder solution in the size press 9, a pair of sprays 16 and 18 positioned one on each side of the web 8 is located immediately before the press rolls 10' and 11' of the size press 9'. These sprays 16 and 18 apply sufficient binder to the web to saturate same so that when the web passes through the nip formed between the rolls 10' and 11' the adhesive solution is squeezed out of the web to maintain a small puddle as indicated at 12' and to thereby properly distribute binder solution in the web. After the binder has been properly distributed, the web traverses a drier 4 and is wound on a reel equivalent to the reel 14. If desired, some of the binder may be applied by the sprays 16 and further added in the press 9'.

The system schematically illustrated in FIG. 3 is quite similar to that shown in FIG. 2 but instead of the binder solution being applied in the size press it is applied at least in part prior to the size press and is distributed by the pressure applied by the press rolls 10' and 11'. This technique provides good distribution of the adhesive throughout the web.

Preferably the web will contain at least 25% chemically liberated fibres and more preferably will be predominantly chemically liberated fibres.

It will be apparent that some fibres will not bond sufficiently to traverse the size press using simple pressure and under these circumstances other techniques for pre-bonding will be required. For example, it would be quite difficult to pre-bond 100% groundwood fibre using the pressing technique for pre-bonding; with such fibre a light adhesive application prior to prepressing might be required to ensure sufficient strength is developed in the prepressing operation.

Table I hereinbelow indicates typical characteristics of a prepressed web formed of bleached softwood kraft fibres pressed at a moisture content of between about 8 and 12% (average about 10%), at various pressures as indicated.

TABLE I

| Physical Properties of Dryformed Webs of Bleached Softwood Kraft Fibres - Prepressed | | | | |
|---|---|---|---|---|
| ROLL PRESSURE p.l.i. | | 500 | 1000 | 2000 |
| Tensile B.L. in Km | MD | 0.6 | 0.5 | 0.5 |
| | CD | 0.5 | 0.5 | 0.3 |
| % Elongation | MD | 1.5 | 1.5 | 1.4 |
| | CD | 1.2 | 1.6 | 1.7 |
| Toughness Ft.Lb./Ft² | MD | 0.1 | 0.2 | 0.1 |
| (at B.W. 60 g/m²) | CD | 0.1 | 0.1 | 0.1 |
| Tear Factor | MD | 10 | 18 | 17 |
| | CD | 9 | 17 | 22 |
| Burst factor | | 1 | 1 | 2 |

It will be noted that the specific properties of the prepressed web clearly indicates that this web is not suitable for use as a paper and basically only has sufficient strength to permit the web to pass through the size press.

A series of tests were conducted using the present invention on softwood kraft pulp prepressed at 1000 lbs. per linear inch with 6 inch rolls and then subject to treatment with different amounts of binder. Table II shows such treatment with different amounts of oxidized starch as a binder.

TABLE II

| % w/w/Starch Solution Concentration | | 10 | 5 | 3 | 1 |
|---|---|---|---|---|---|
| Basis weight g/m² | | 67 | 79 | 90 | 76 |
| Caliper in/1000 | | 4.2 | 5.5 | 5.9 | 5.5 |
| Bulk cc/g | | 1.7 | 1.8 | 1.7 | 1.9 |
| Tensile B.L. in Km | MD | 5.1 | 3.5 | 2.4 | 1.4 |
| | CD | 4.5 | 3.0 | 2.0 | 1.4 |
| % Elongation | MD | 5.2 | 4.3 | 2.7 | 1.9 |
| | CD | 5.1 | 4.4 | 2.7 | 2.0 |
| Toughness | MD | 8.5 | 5.9 | 1.9 | 0.9 |
| ft.lb/ft² | CD | 7.0 | 4.9 | 1.6 | 0.8 |
| Tear Factor | MD | 60 | 80 | 88 | 64 |
| | CD | 48 | 86 | 78 | 71 |
| Burst Factor | | 29 | 25 | 16 | 7 |

Table III is similar to Table II with the exception that the adhesive used was an animal glue.

TABLE III

| % w/w/ Animal Glue Solution Concentration | | 10 | 5 | 3 | 1 |
|---|---|---|---|---|---|
| Basis weight f/m² | | 84 | 75 | 84 | 83 |
| Caliper in/1000 | | 5.3 | 5.7 | 5.3 | 5.4 |
| Bulk cc/g | | 1.6 | 1.9 | 1.6 | 1.7 |
| Tensile B.L. in Km | MD | 6.0 | 4.7 | 3.2 | 2.1 |
| | CD | 5.9 | 4.3 | 3.0 | 1.8 |
| % Elongation | MD | 5.5 | 5.3 | 3.9 | 2.7 |
| | CD | 6.0 | 5.1 | 4.0 | 2.6 |
| Toughness | MD | 12.8 | 8.3 | 3.6 | 1.8 |
| ft.lb/ft | CD | 14.1 | 7.0 | 3.6 | 1.5 |
| Tear Factor | MD | 64 | 68 | 90 | 80 |
| | CD | 59 | 73 | 89 | 84 |
| Burst Factor | | 33 | 37 | 24 | 11 |

It is also possible to incorporate both a binder and a sizing agent at the size press. Table IV illustrates that a well sized paper may be formed by the technique of the present invention wherein both a sizing agent and a binder are applied at the size press.

TABLE IV

| | | |
|---|---|---|
| % w/w Starch Solution | 10 | — |
| % w/w Starch/Scripset* Solution | — | 8.0/0.5 |
| Basis Weight g/m² | 117 | 134 |
| Caliper in/1000 | 7.2 | 7.8 |
| Bulk cc/g | 1.6 | 1.5 |
| Burst p.s.i. | 48 | 47 |
| Burst Factor | 29 | 24 |
| Water Drop min. | Instant | 30+ |
| Pen Test | Poor | Good |

TABLE IV-continued

| | | |
|---|---|---|
| Ink Flot. min. | Instant | 30+ |
| Wax Pluck | 18+ | 16+ |

*Registered Trade Mark for a neutral sizing agent

It is to be noted that the percent weight on weight of starch solution or animal glue indicates the concentration of the starch or animal glue in water. In all cases the amount of solution applied was approximately equal to the weight of the web being treated and thus the percent weight on weight relationship generally indicates the amount of binder solids in the bonded web.

It is apparent from Table II that the application of 5% starch produces a sheet with strength characteristics similar to those of many commercially available papers. Less than 3% starch results in a sheet having strength characteristics that would be acceptable for some commercial paper grades.

Similarly, when animal glue is used as indicated in Table III, 3% animal glue provides a very adequate bonding of the paper structure.

Table IV illustrates that the application of a combination of starch and sizing agent results in a paper web which is well sized and has good strength characteristics.

It has also been found that if desired a dye may be added with the binder and/or sizing agent, for example, in the size press to produce a coloured sheet.

In the above description, the size presses used have been the type designated by the industry as "a horizontal size press," however, the invention can also be practiced using an "inclined size press" or a vertical size press."

Further modifications will be evident to those skilled in the art without departing from the spirit of the invention as defined in the appended claims.

What we claim is:

1. A method of continuously making a dry formed consolidated sheet of paper comprising:

a. dry forming fibres to form a continuous web, said fibres being predominantly discrete cellulose fibres previously liberated by chemical digestion of cellulosic material;

b. continuously passing said web containing 4 to 25% moisture based on the weight of said fibres between a pair of press rolls at a pressure of 500 – 3,000 lbs. per lineal inch and prebonding said fibres together thereby to impart sufficient strength to said web to enable it to pass through the nip of a size press when said web is substantially saturated with a binder in a liquid carrier but without significantly imparting the ability of said web to be impregnated by said binder in said liquid carrier;

c. continuously applying said binder in said liquid carrier to said prebonded web, the amount of said binder in said liquid carrier being sufficient to saturate said web in said nip;

d. continuously passing said prebonded web through said nip of said size press at a nip pressure of 20 to 150 lbs. per linear inch and at a speed of at least 50 ft. per minute said binder in said liquid carrier being at a temperature of 15 – 80° C thereby to distribute said binder substantially uniformly throughout said web and;

e. drying said web to form a continuous bonded consolidated sheet of paper.

2. A method as defined in claim 1 wherein step (b) is at room temperature.

3. A method as defined in claim 1 wherein step (b) applies substantially uniform pressure across the web and is at room temperature.

4. A method as defined in claim 1 wherein said binder in said liquid carrier of step (c) is applied in the size press of step (d).

5. A method as defined in claim 1 wherein step (c) applies binder in the amount of between 2 and 20% based on the weight of fibre.

6. A method as defined in claim 1 wherein said binder applied in step (c) is selected from the group consisting of starch adhesives, animal glue adhesives and carboxymethyl cellulose type adhesives and is applied as a water solution in the size press of step (d) and in the amount of between 2 and 20% based on the weight of said cellulose fibres.

7. A method as defined in claim 1 wherein at least a part of said binder applied in step (c) is applied as a spray and the remainder of said binder is applied in the size press of step (d) with all of said binder being distributed in said web by said size press in step (d).

* * * * *